US006711834B1

(12) United States Patent
Kita

(10) Patent No.: US 6,711,834 B1
(45) Date of Patent: Mar. 30, 2004

(54) SOLE STRUCTURE OF ATHLETIC SHOE

(75) Inventor: Kenjiro Kita, Nara (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/937,206

(22) PCT Filed: Jun. 12, 2000

(86) PCT No.: PCT/JP00/03801

§ 371 (c)(1),
(2), (4) Date: Sep. 21, 2001

(87) PCT Pub. No.: WO01/95754

PCT Pub. Date: Dec. 20, 2001

(51) Int. Cl.[7] ..... A43B 13/18

(52) U.S. Cl. ..... 36/27; 36/35 R; 36/30 R; 36/31

(58) Field of Search ..... 36/27, 28, 29, 36/35 R, 30 R, 31

(56) References Cited

U.S. PATENT DOCUMENTS

| | | | | |
|---|---|---|---|---|
| 4,439,936 A | | 4/1984 | Clarke et al. | |
| 4,490,928 A | * | 1/1985 | Kawashima | 36/30 R |
| 4,972,611 A | * | 11/1990 | Swartz et al. | 36/28 |
| 5,025,573 A | | 6/1991 | Giese et al. | |
| 5,195,256 A | * | 3/1993 | Kim | 36/27 |
| 5,315,769 A | * | 5/1994 | Barry et al. | 36/28 |
| 5,572,805 A | | 11/1996 | Giese et al. | |
| 5,575,089 A | | 11/1996 | Giese et al. | |

FOREIGN PATENT DOCUMENTS

| | | |
|---|---|---|
| EP | 990397 | * 4/2000 |
| JP | 59-90503 | 5/1984 |
| JP | 64-500491 | 2/1989 |
| JP | 8-303 | 1/1996 |
| JP | 11-203 | 1/1999 |
| JP | 11-346803 | 12/1999 |

* cited by examiner

*Primary Examiner*—Ted Kavanaugh
(74) *Attorney, Agent, or Firm*—W. F. Fasse; W. G. Fasse

(57) ABSTRACT

The present invention relates to a sole structure of an athletic shoe and its object is to effectively absorb a shock applied to a shoe heel portion directly after landing and to prevent pronation or supination after landing. The sole structure of the athletic shoe according to the present invention includes an upper midsole (3*a*) that is formed of a soft elastic material and that extends from the heel portion to a forefoot portion of a shoe through a midfoot portion, a lower midsole (3*b*) that is formed of a soft elastic material and that is disposed at least at the heel portion under the upper midsole (3*a*), a wavy plate (4) that is inserted between the upper and lower midsoles (3*a*, 3*b*) and that has a wavy corrugation at least at the heel portion, which progresses from the rear end side of the heel portion to the midfoot portion, an outsole (5) fitted to the bottom surface of the lower midsole (3*b*), and a shock absorbing member (7) provided at a heel strike region of the heel portion between the wavy plate (4) and the outsole (5).

33 Claims, 12 Drawing Sheets

SOLE STRUCTURE OF ATHLETIC SHOE

This is a 371 of PCT/JP00/03801 filed on Jun. 12, 2000.

TECHNICAL FIELD

The present invention relates to a sole structure of an athletic shoe, and more particularly, a sole structure that has a wavy plate inserted between an upper midsole and a lower midsole.

BACKGROUND OF THE INVENTION

A sole for an athletic shoe used in various sports includes a midsole and an outsole that is fitted on the bottom surface of the midsole and directly contacts the ground. The midsole is generally formed of a soft elastic material to ensure adequate cushioning properties as a shoe.

Incidentally, as a sports shoe, not only cushioning properties but also running stability is required. That is, there exists a need to prevent excessive lateral or transverse deformation of a sole, such as pronation or supination occurring at the time of striking onto the ground.

In order to prevent such a lateral deformation, as shown in Japanese patent application laying-open publication No. 11-203, Mizuno Corporation proposed a midsole structure having a wavy plate with a corrugation inserted thereinto. In this case, by the action of the wavy plate, a resistance force occurs to restrain a heel portion of a midsole from deforming in the transverse direction at the time of impacting onto the ground, thereby preventing the heel portion of a shoe from laterally deforming.

Such a wavy plate prevents lateral deformation of a shoe, but it decreases cushioning properties of the whole midsole. In the midsole structure shown in the above-mentioned publication, amplitude of a corrugation of a wavy plate is suitably varied between a front end and a rear end or between a medial side and a lateral side of the shoe heel portion to achieve cushioning properties. Although such a method of securing cushioning properties and preventing lateral deformation was adequate for runners whose pronation or supination is not so great, but it was inadequate for runners whose pronation or supination is greater. In athletic sports, such as tracks, field events, tennis, volleyball, basketball, or the like, an impact load three to five times an athlete's weight is applied on landing and especially on jumping, very high impact load about ten times an athlete's weight is applied. In these sports, adequate cushioning properties were not necessarily achieved by the above-mentioned midsole structure.

The present invention has been made in view of these conventional circumstances, and its object is to provide a sole structure of an athletic shoe that can not only effectively absorb an impact load applied to a heel portion of the shoe directly after contacting the ground but also securely prevent a pronation or supination of a shoe wearer's foot.

SUMMARY OF THE INVENTION

A sole structure of an athletic shoe according to a first invention includes an upper midsole that is formed of a soft elastic material and that extends from a heel portion of the shoe to a forefoot portion through a midfoot portion, a lower midsole that is formed of a soft elastic material and that is disposed at least at the heel portion of the shoe under the upper midsole, a wavy plate or a corrugated sheet having a wavy corrugation that progresses from a rear end side of the heel portion toward the midfoot portion and that is provided at least at the heel portion between the upper and lower midsoles, an outsole that is fitted on the bottom surface of the lower midsole, and a shock absorbing member that is fitted at a "heel strike region" of the heel portion of the shoe between the wavy plate and the outsole.

Here, the term, "heel strike region" used herein means a region of the heel portion of a shoe that contacts the ground at a first stage of landing when a shoe wearer lands on the ground from the heel portion of the shoe.

As a "shock absorbing member", a high molecular compound having viscoelasticity is preferable. Specifically, polystyrene, polyurethane, or polyisoprene elastomer may be utilized. Also, a blend type of these mixed elastomers, or both solid and foamed types are included. The wavy plate is preferably formed of thermoplastic resin or thermosetting resin.

In this first invention, an impact load applied to the heel strike region of the shoe heel portion directly after contacting the ground is effectively absorbed by the shock absorbing member fitted at the heel strike region. And after landing onto the ground, pronation or supination of a shoe wearer's foot is securely prevented by the action of the wavy plate.

Also, in this case, because the shock absorbing member is provided between the wavy plate and the outsole, that is, on the side of the lower midsole, stability of the shoe heel portion on landing is secured to some extent by the upper midsole, and the impact load applied to the outsole is absorbed by the shock absorbing member. In contrast, when the shock absorbing member is provided on the upper midsole side, that is, between the upper and the wavy plate, lateral deformation of the shoe heel portion is easy to occur on landing and stability of the shoe heel portion is hardly maintained.

In a sole structure of an athletic shoe according to a second invention, the shock-absorbing member is formed of a viscoelastic material having 70% or more energy loss, or preferably, 85% or more energy loss.

Here, the term, "viscoelasticity" used herein means a phenomenon in which deformation caused by an external force appears as an overlap of elastic deformation and viscous flow, and such properties are especially remarkably seen in high molecular compound.

When an impact force is applied to the viscoelastic material, a portion of supplied energy by the impact force is converted into heat energy and the like, and by the amount of the converted energy, the impact force is absorbed and a shock is relieved. On the other hand, the other portion of supplied energy, which is not liveried converted into heat energy and the like, restores the deformed viscoelastic material to its original condition before deformation as a restoring energy by elastic rebound. In this case, the amount of supplied energy minus the restoring energy is an energy loss.

Generally, 70% or 85% or more energy loss is considerably high value. When a shock absorbing member formed of only a viscoelastic material having such a high energy loss is provided in the midsole, a shoe wearer receives a feeling of floating from the ground during activities, especially running, and as a result, he or she cannot exert a necessary kick power to the ground at the start of running and cannot control activities.

In contrast, according to the present invention, since such a shock absorbing member is used with the wavy plate, compressive and lateral deformations of the upper and lower midsoles after landing are restrained by the action of the wavy plate. Thus, a shoe wearer can exert a sufficient kick force to the ground and control activities.

In other words, as in the present invention, that the wavy plate is provided in the midsole enables to use the shock absorbing material formed of a viscoelastic material having 70% or more, or 85% or more high energy loss.

According to the present invention, even in sports where very high impact force is applied on jumping, a shock applied to the shoe heel portion is absorbed and relieved by the shock absorbing member having 70% or more, or 85% or more high energy loss, and lateral deformation of the shoe heel portion is prevented and activities are controlled by the action of the wavy plate.

In a sole structure of an athletic shoe according to a third invention, the shock absorbing member has hardness of 55 degrees or less, preferably, 45 degrees or less at Asker C scale. In this case, an impact force applied to the shock absorbing member is absorbed by converting a portion of supplied energy by the impact force into heat energy and the like. In addition, the reason why the hardness of 55 degrees or less at Asker C scale is employed is that less shock absorbing properties or less cushioning properties are acquired if the hardness is greater than 55 degrees at Asker C scale.

In a sole structure of an athletic shoe according to a fourth invention, the shock absorbing member extends along the outer circumference of the shoe heel portion and has a width of 10(mm) or more.

Here, the reason why the width of the shock absorbing member is limited to 10(mm) or more is that at least the width of 10(mm) is required to absorb a shock directly after contacting the ground. And the reason why the width over 10(mm) is allowed is that even when the shock absorbing member has the width over 10(mm) the whole midsole can be prevented from being excessively compressed by the action of the wavy plate.

In a sole structure of an athletic shoe according to a fifth invention, there exist inequalities, $0.1L \leqq L_L \leqq 0.5L$ and $L_M \leqq 0.1L$.

Here, L: entire length of a horizontal projection plane of an outsole.

$L_L$: length of a lateral side region of a shock absorbing member measured from the rearmost end of the heel portion along the shoe elongated direction.

$L_M$: length of a medial side region of a shock absorbing member measured from the rearmost end of the heel portion along the shoe elongated direction.

In this case, since the lateral side region of the shock absorbing member is longer than the medial side region thereof, a shoe sole structure, which is suitable for sports such as tracks where landing frequently occurs on the lateral side, can be achieved.

Here, the reason why the elongated length $L_L$ of the shock absorbing member is limited to 0.1L or more is that at least the length of 0.1L is required to absorb a shock directly after landing on the lateral side. The reason why the elongated length $L_L$ is limited to 0.5L or less is as follows: It is sufficient that the shock absorbing member extends to the midfoot portion at the longest, and if the shock absorbing member has the length over 0.5L, it reaches the forefoot portion. Further, the reason why the elongated length $L_M$ is limited to 0.1L or less is that if the length is over 0.1L it promotes pronation.

In a sole structure of an athletic shoe according to a sixth invention, amplitude of a wavy configuration of the wavy plate at the heel portion is smaller on the lateral side and greater on the medial side. That is, moment of inertia of area of the wavy plate is greater on the medial side, and thus, compressive hardness, which represents hardness to compressive deformation of the whole midsole, is higher on the medial side.

This sixth invention exercises a superior effect when it is combined with the fifth invention. That is, in sports such as tracks, when a runner lands on the ground from the lateral side of the heel portion during running, the shock absorbing member on the lateral side absorbs a shock to the outsole directly after contacting the ground. And the medial side of the midsole having greater compressive hardness sustains leaning of foot toward the medial side of the heel portion after landing. In such a way, by interaction between the shock absorbing member and the wavy plate, a shock applied to the shoe heel portion directly after contacting the ground is effectively absorbed and pronation of a shoe wearer's foot is securely prevented.

In a sole structure of an athletic shoe according to a seventh invention, there exist inequalities, $L_L \leqq 0.1L$ and $0.1L \leqq L_M \leqq 0.5L$.

Here, L: entire length of a horizontal projection plane of an outsole.

$L_L$: length of a lateral side region of a shock absorbing member measured from the rearmost end of the heel portion along the shoe elongated direction.

$L_M$: length of a medial side region of a shock absorbing member measured from the rearmost end of the heel portion along the shoe elongated direction.

In this case, since the medial side region of the shock absorbing member is longer than the lateral side region thereof, a shoe sole structure, which is suitable for sports such as tennis or basketball where landing from the medial side and transverse movements frequently occur, can be achieved.

Here, the reason why the elongated length $L_M$ of the shock absorbing member is limited to 0.1L or more is that at least the length of 0.1L is required to absorb a shock directly after landing on the medial side. The reason why the elongated length $L_M$ is limited to 0.5L or less is as follows: It is sufficient that the shock absorbing member extends to the midfoot portion at the longest, and if the shock absorbing member has the length over 0.5L, it reaches the forefoot portion. Further, the reason why the elongated length $L_L$ is limited to 0.1L or less is that if the length is over 0.1L it promotes supination.

In a sole structure of an athletic shoe according to an eighth invention, amplitude of a wavy configuration of the wavy plate at the heel portion is smaller on the medial side and greater on the lateral side. That is, moment of inertia of area of the wavy plate is greater on the lateral side, and thus, compressive hardness, which represents hardness to compressive deformation of the whole midsole, is higher on the lateral side. This eighth invention exercises a superior effect when it is combined with the seventh invention. That is, in sports such as tennis, basketball, or the like, when a player lands on the ground from the medial side of the heel portion during a game, the shock absorbing member on the medial side absorbs a shock to the outsole directly after contacting the ground. And the lateral side of the midsole having greater compressive hardness sustains leaning of foot toward the lateral side of the heel portion after landing. In such a way, by interaction between the shock absorbing member and the wavy plate, a shock applied to the shoe heel portion directly after contacting the ground is effectively absorbed and supination of a shoe wearer's foot is securely prevented.

In a sole structure of an athletic shoe according to a ninth invention, there exist inequalities, $0.1L \leqq L_L \leqq 0.15L$ and $0.1L \leqq L_M \leqq 0.15L$.

Here, L: entire length of a horizontal projection plane of an outsole.

LL: length of a lateral side region of a shock absorbing member measured from the rearmost end of the heel portion along the shoe elongated direction.

LM: length of a medial side region of a shock absorbing member measured from the rearmost end of the heel portion along the shoe elongated direction.

In this case, since the medial side region of the shock absorbing member has almost the same length as the lateral side region thereof, a shoe sole structure, which is suitable for sports such as walking where landing occurs on the central portion of the rear end side of the shoe heel portion, is achieved.

Here, the reason why each of the elongated lengths LL and LM of the shock absorbing member is limited to 0.1L or more is that at least the length of 0.1L is required to absorb a shock directly after landing on the rear central portion. The reason why each of the elongated lengths LL and LM is limited to 0.15L or less is as follows: It is sufficient that the shock absorbing member has the length of 0.15L at the longest to absorb a shock applied to the rear central portion, and if the shock absorbing member has the length over 0.15L, it may promote pronation and supination.

In a sole structure of an athletic shoe according to a tenth invention, amplitude of a wavy configuration of the wave plate at the heel medial portion is nearly equal to that of a wavy configuration of the wavy plate at the heel lateral portion. This tenth invention is suitable for a shoe such as a walking shoe where landing on the ground frequently occurs on the general central portion on the rear end side of the shoe heel portion.

DETAILED DESCRIPTION OF THE PREFERRED EMBODIMENTS

Explanation of the Whole Structure of Athletic Shoe

Figure 1:
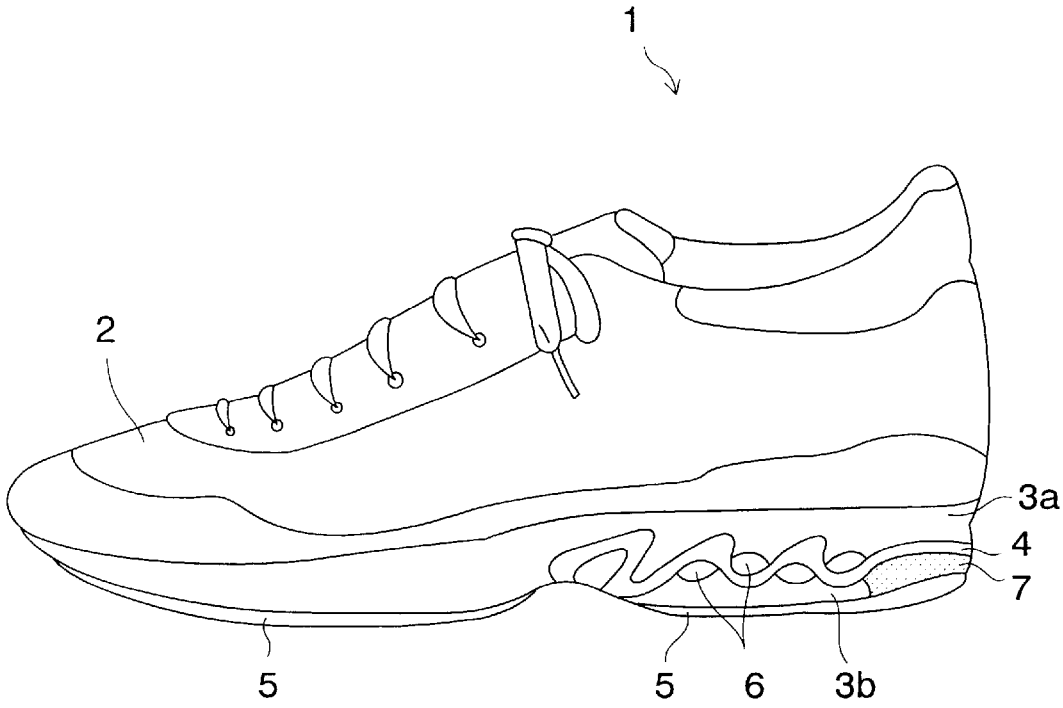
FIG. 1 is a side view of a running shoe employing a sole structure according to an embodiment of the present invention.

Here, a running shoe will be explained as an example of an athletic shoe. As shown in FIG. 1, a sole of an athletic shoe 1 includes an upper midsole 3*a* that extends from a heel portion to a forefoot portion of the shoe and that is fixed to a bottom portion of an upper 2, a lower midsole 3*b* that is disposed mainly at the heel portion of the shoe under the upper midsole 3*a*, a wavy plate or corrugated sheet 4 that has a wavy corrugation and that is inserted between the upper midsole 3*a* and the lower midsole 3*b*, and outsole 5 that is fixed to the bottom surfaces of the upper and lower midsoles 3*a*, 3*b* and that directly contacts the ground, and a shock absorbing member 7 that is provided at a heel strike region between the wavy plate 4 and the outsole 5.

The upper midsole 3*a* and the lower midsole 3*b* are provided to relieve a shock that is applied to the bottom portion of the shoe at the time of landing, and they are generally formed of a soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used.

The wavy plate 4 is preferably formed of thermoplastic resin such as thermoplastic polyurethane (TPU) of comparatively rich elasticity, polyamide elastomer (PAE), ABS resin or the like. Alternatively, the wavy plate 4 is formed of thermosetting resin such as epoxy resin, unsaturated polyester resin or the like. In addition, a plurality of transversely extending holes 6 are formed at regions where the upper and lower midsoles 3*a*, 3*b* contact the wavy plate 4. These holes 6 are provided to improve cushioning properties of the whole midsole and to reduce its weight.

The shock absorbing member 7 is provided to absorb and relieve a shock immediately after contacting the ground, and a high molecular compound, or polymer having viscoelasticity is preferable. Specifically, polystyrene, polyplefin, polyurethane, polyester, polyamide, polydiene, polyisoprene, polyethylene, fluorine, or silicone elastomer may be utilized. Also, a blend type of these mixed elastomers, or both solid and foamed types may be included.

When the shock absorbing member 7 is formed using these elastomers, additives to the elastomers may be adjusted and an expansion ratio may be varied to gain 70% or more energy loss, preferably 85% or more energy loss.

In another aspect of the present invention, as the shock absorbing member 7, a member having hardness of 55 degrees or less, preferably 45 degrees or less at Asker C scale is used. Here, the reason why the hardness is limited to 55 degrees or less at Asker C scale is that shock absorbing properties or cushioning properties decreases if the hardness is over 55 degrees.

Specified examples of the shock absorbing member 7 are shown below:

EXAMPLE 1

A formed polymer having a base polymer formed of 70 portion of "HYBRAR (trade mark)" of Kuraray Co., Ltd. that is polystyrene/polyisoprene elastomer, and 30 portion of isoprene rubber (IR). Hardness is 40 degrees at Asker C scale; specific gravity is 0.31; 89% energy loss, which is measured by Mizuno Corporation.

EXAMPLE 2

"Sorbothane (trademark)" that is polyurethane elastomer of Sanshin Enterprises Co., Ltd. Hardness is 41 degrees at Asker C scale; specific gravity is 1.37; 80% energy loss, which is measured by Mizuno Corporation.

The above-mentioned examples are mere ones and various compositions other than the above-mentioned ones may be employed by suitably changing kinds of elastomers and kinds or amounts of the additives introduced thereinto.

Explanation of Sole Structure

Figure 2:
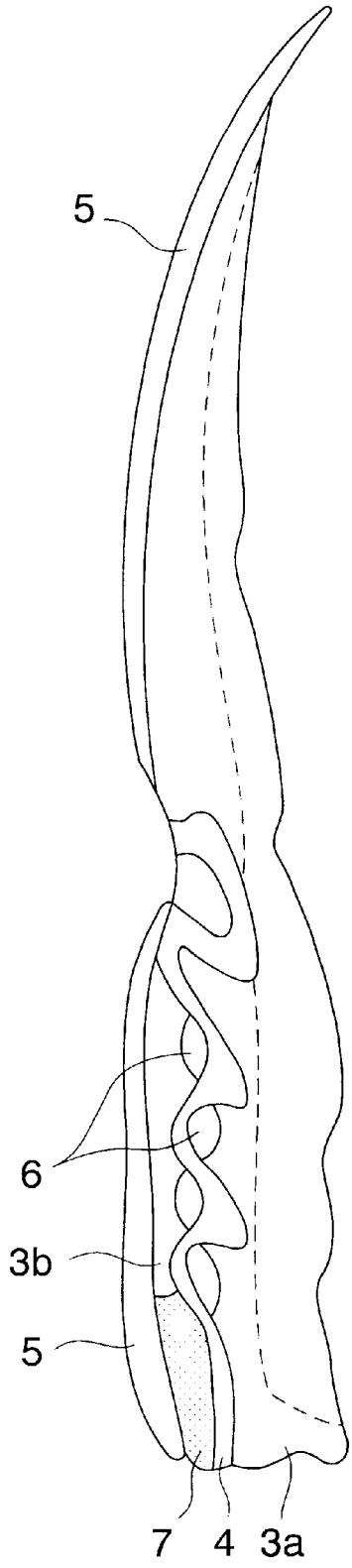
FIG. 2 is a lateral side view of the sole structure of FIG.1.
Figure 3:
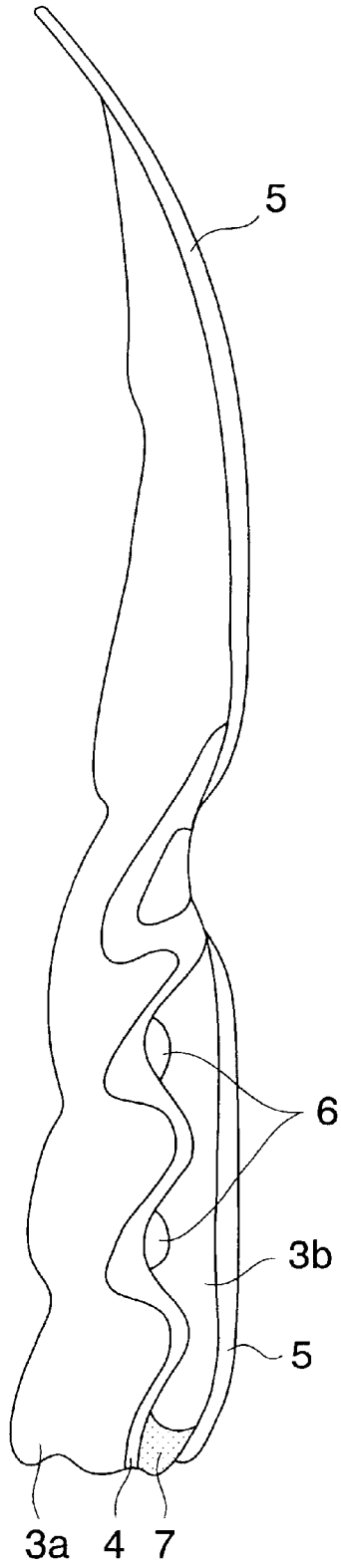
FIG. 3 is a medial side view of the sole structure of FIG. 1.
Figure 4:
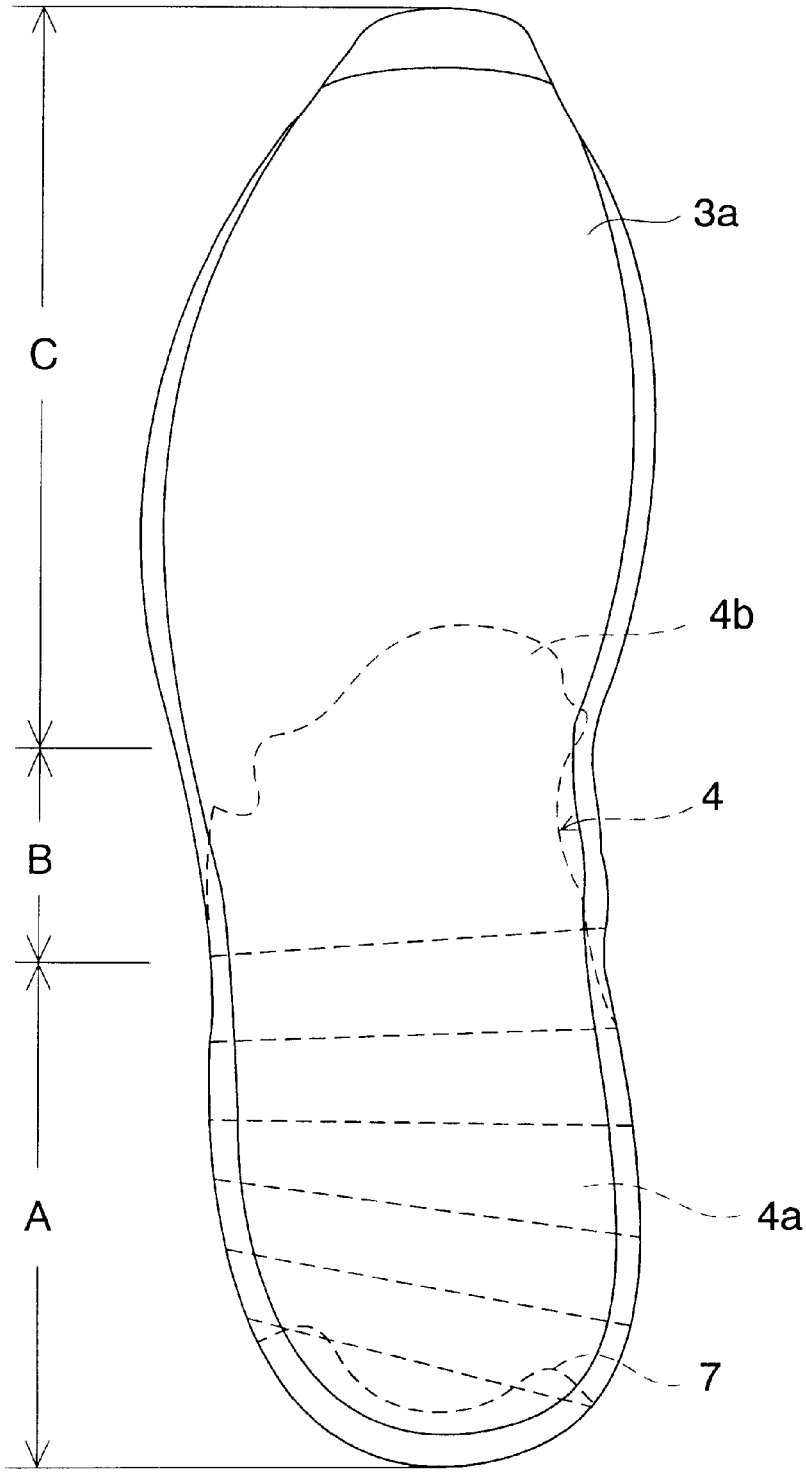
FIG. 4 is a top plan view of the sole structure of FIG. 1.

The sole structure of the running shoe 1 will be explained hereinafter by using FIGS. 2 to 7. As shown in FIGS. 2 to 4, the wavy plate 4 extends from a heel part A of the shoe to a rear end portion,of a forefoot part C through a midfoot part (or plantar arch part) B. The wavy plate 4 includes a heel portion 4*a* formed with a wavy corrugation that progresses from the rear end side of the heel part A to the front end side, and a midfoot portion 4*b* in the shape of generally flat plate that is integrally formed with the heel portion 4*a*. Dotted lines extending in the transverse direction at the heel portion 4*a* in FIG. 4 indicate crest lines or trough lines of a wavy corrugation of the wavy plate 4.

In the case of a shoe (not shown) where the wavy plate 4 extends toward the front end of the forefoot part C, the lower midsole 3*b* also extends toward the front end of the forefoot part C, correspondingly to the wavy plate 4.

Figure 6:
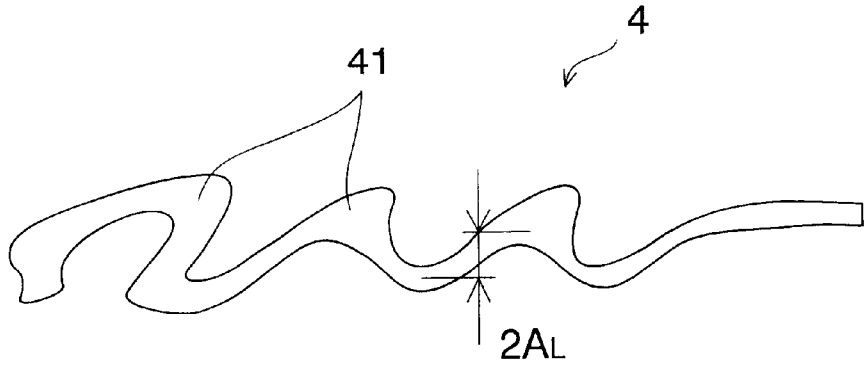
FIG.6 is a lateral side view of the wavy plate.
Figure 7:
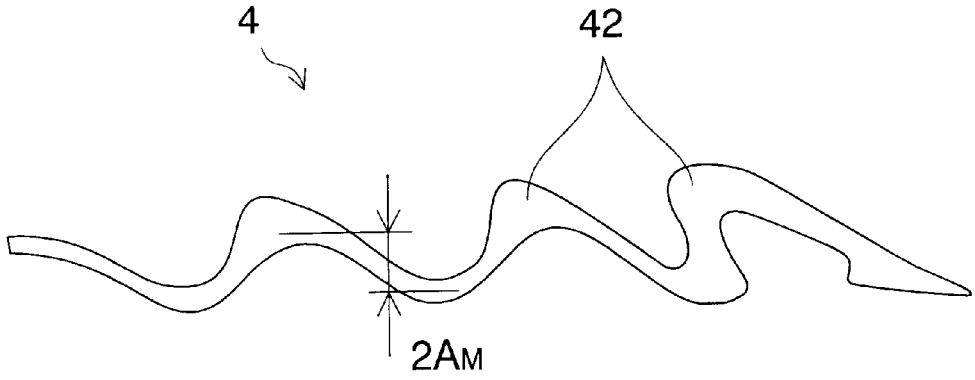
FIG. 7 is a medial side view of the wavy plate.

As shown in FIGS. 6 and 7, amplitude of a wavy corrugation of the wavy plate 4 is $A_L$ on the lateral side and $A_M$ on the medial side, and there exists an inequality, $A_M > A_L$.

In addition, the wavy plate 4 is formed with flanges 41, 42 protruding upwardly and downwardly These flanges 41, 42 are provided only at the both edges of the medial and lateral sides of the heel part A and are not provided between the both edges of the medial and lateral sides of the heel part A. Therefore, each of the flanges 41, 42 is not directly related to amplitude of a wavy corrugation of the wavy plate 4, but by providing these flanges 41, 42, lateral or transverse deformation of the upper midsole 3*a* is further restrained.

Figure 5:
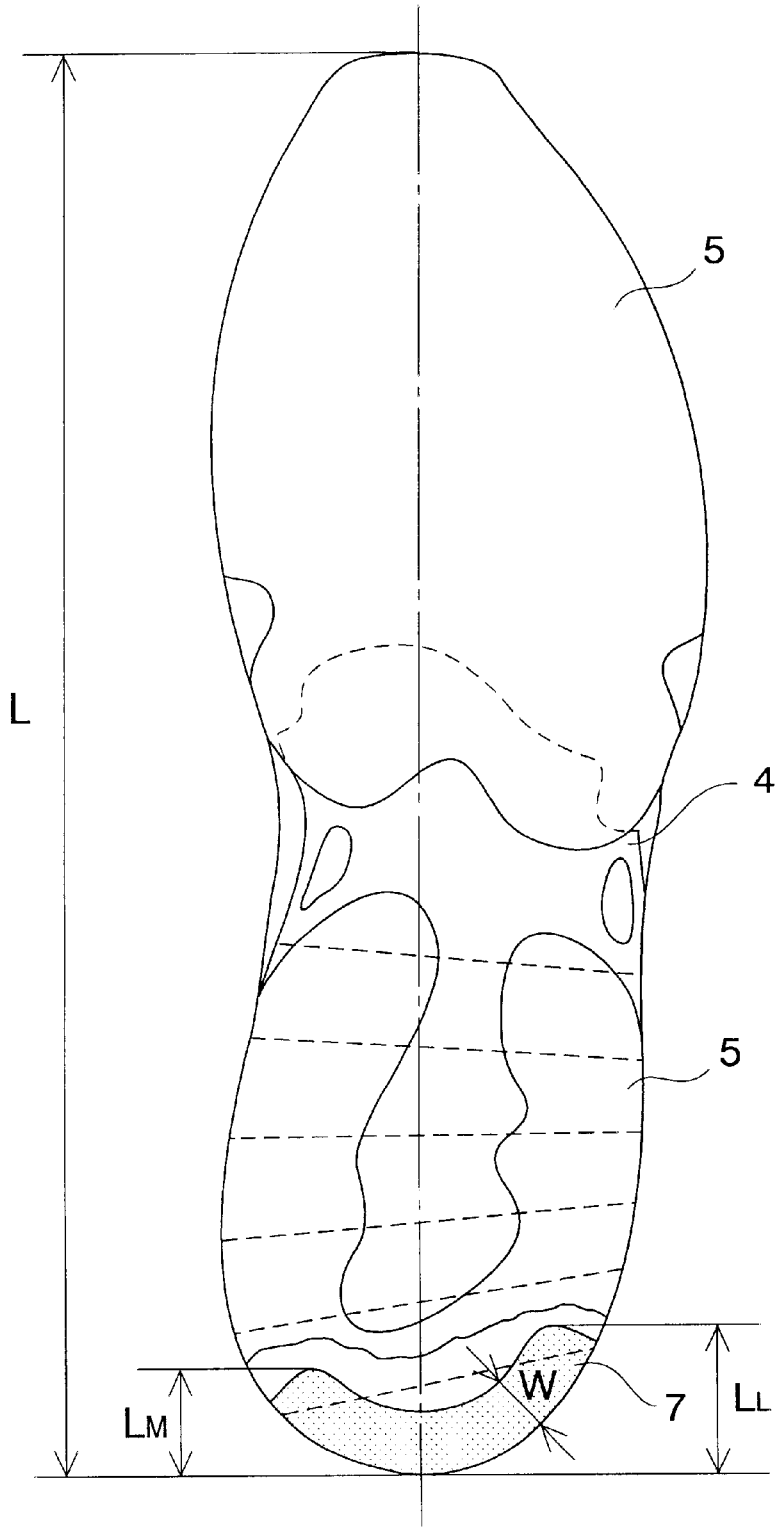
FIG. 5 is a cutaway bottom view of the sole structure of FIG. 1.

As shown in FIGS. 4 and 5, the shock absorbing member 7 extends as a curved strip along the outer circumference of the shoe heel part A and is disposed at a heel strike region of this running shoe 1, or rear end portion of the heel part A. The shock absorbing member 7 in the shape of a curved strip has a width W, which satisfies an inequality, $W \geqq 10$(mm).

Here, the reason why the width of the shock absorbing member is limited to 10(mm) or more is that at least 10(mm) is required to absorb a shock immediately after contacting the ground. And the reason why the width over 10(mm) is allowed is that even when the shock absorbing member has the width over 10(mm) the whole midsole can be prevented from being excessively compressed at the time of landing by the action of the wavy plate 4.

Furthermore, there exist inequalities, $0.1L \leqq L_L \leqq 0.5L$ and $L_M \leqq 0.1L$.

Here, L: entire length of a horizontal projection plane of the outsole 5.

$L_L$: length of a lateral side region of the shock absorbing member 7 measured from the rearmost end of the heel portion along the shoe elongated direction.

$L_M$: length of a medial side region of the shock absorbing member 7 measured from the rearmost end of the heel portion along the shoe elongated direction.

In other words, the laterally extending portion $L_L$ is 10 to 50% of the entire length L, and the medially extending portion $L_M$ is less than or equal to 10% of the entire length L.

Then, function and effect of this embodiment will be described. A shock applied to the heel strike region of the shoe heel part A directly after striking onto the ground during running is effectively absorbed and relieved by converting a portion of energy by the shock into heat energy and the like through the shock absorbing member 7 fitted at the heel strike region. Also, after landing, pronation of a shoe wearer's foot is securely prevented by the action of the wavy plate 4.

Moreover, in this embodiment, the shock absorbing member is formed of viscoelastic materials having a higher energy loss, such as 70% or more, or 85% or more. Thus, even when a very high impact load is applied at the time of jumping, a shock to the shoe heel part immediately after contacting the ground is securely absorbed, and compressive deformation and lateral deformation of the upper and lower midsoles 3*a*, 3*b* after landing are securely restrained by the action of the wavy plate 4. In such a way, a shoe wearer can exert a sufficient kick power to the ground and control activities.

Furthermore, according to this embodiment, since the shock absorbing member 7 extends along a longer area at the lateral side of the heel part A than the medial side, a shoe sole structure that is suitable for tracks is achieved. Because, in athletics such as tracks, athletes land on the ground more frequently from the lateral side of the heel portion.

Here, the reason why the elongated length $L_L$ of the shock absorbing member 7 is limited to 0.1L or more is that at least the length of 0.1L is required to absorb a shock directly after landing from the lateral side. The reason why the elongated length $L_L$ is limited to 0.5L or less is as follows: It is sufficient that the shock absorbing member extends to the midfoot portion at the longest, and if the shock absorbing member has the length over 0.5L, it reaches the forefoot portion. Further, the reason why the elongated length $L_M$ is limited to 0.1L or less is that if the length is over 0.1L it promotes pronation.

Also, according to this embodiment, as abovementioned, amplitude of a wavy configuration of the wavy plate 4 at the heel portion is smaller on the lateral side and greater on the medial side. That is, moment of inertia of area of the wavy plate 4 is greater on the medial side, and thus, compressive hardness, which represents hardness to compressive deformation of the whole midsole, is higher on the medial side.

Therefore, in this case, when a runner lands on the ground from the lateral side of the heel part A during running, the shock absorbing member 7 on the lateral side absorbs a shock to the outsole directly after contacting the ground. And the medial side of the midsole having greater compressive hardness sustains leaning of a foot toward the medial side of the heel portion after landing, and thus, lateral deformation of the heel part A after landing and pronation of a foot is prevented. In such a way, by interaction between the shock absorbing member 7 and the wavy plate 4, a shock applied to the shoe heel part directly after contacting the ground is effectively absorbed and pronation of a shoe wearer's foot is securely prevented.

Alternative Embodiment 1

Figure 4A:
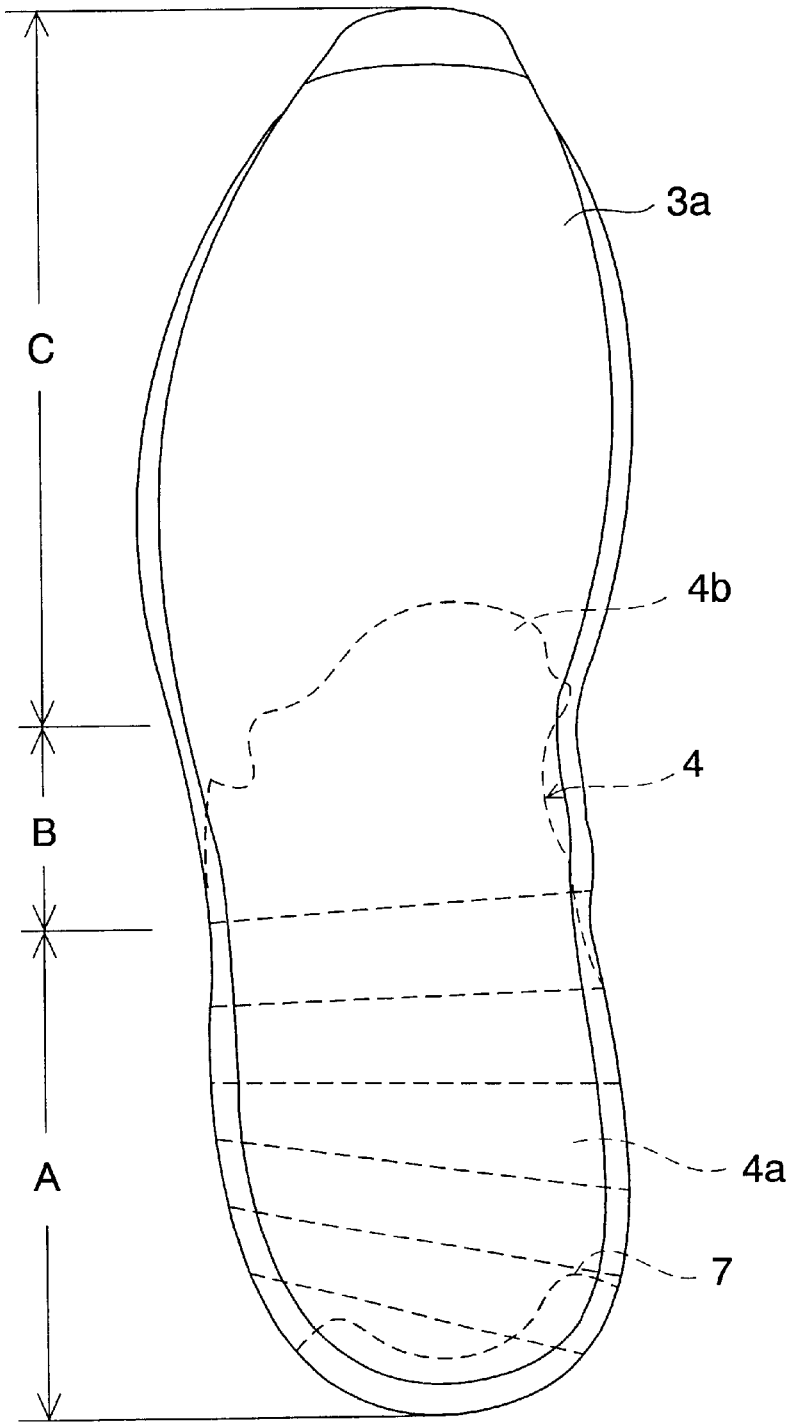
FIGS. 4A and 4B are top plan views like FIG. 4, but respectively show two alternative embodiments of the configuration of the shock absorbing member.
Figure 4B:
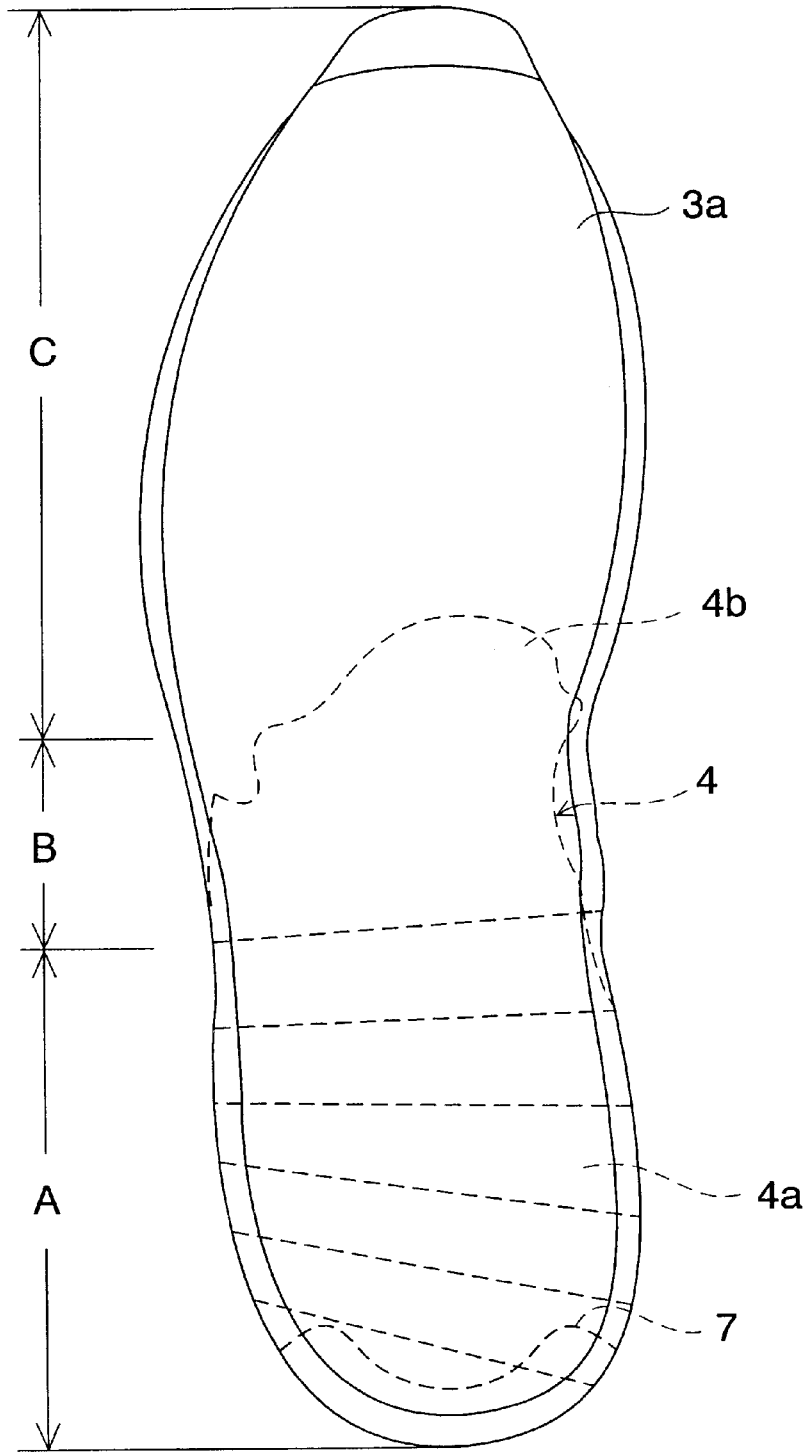
Figure 5A:
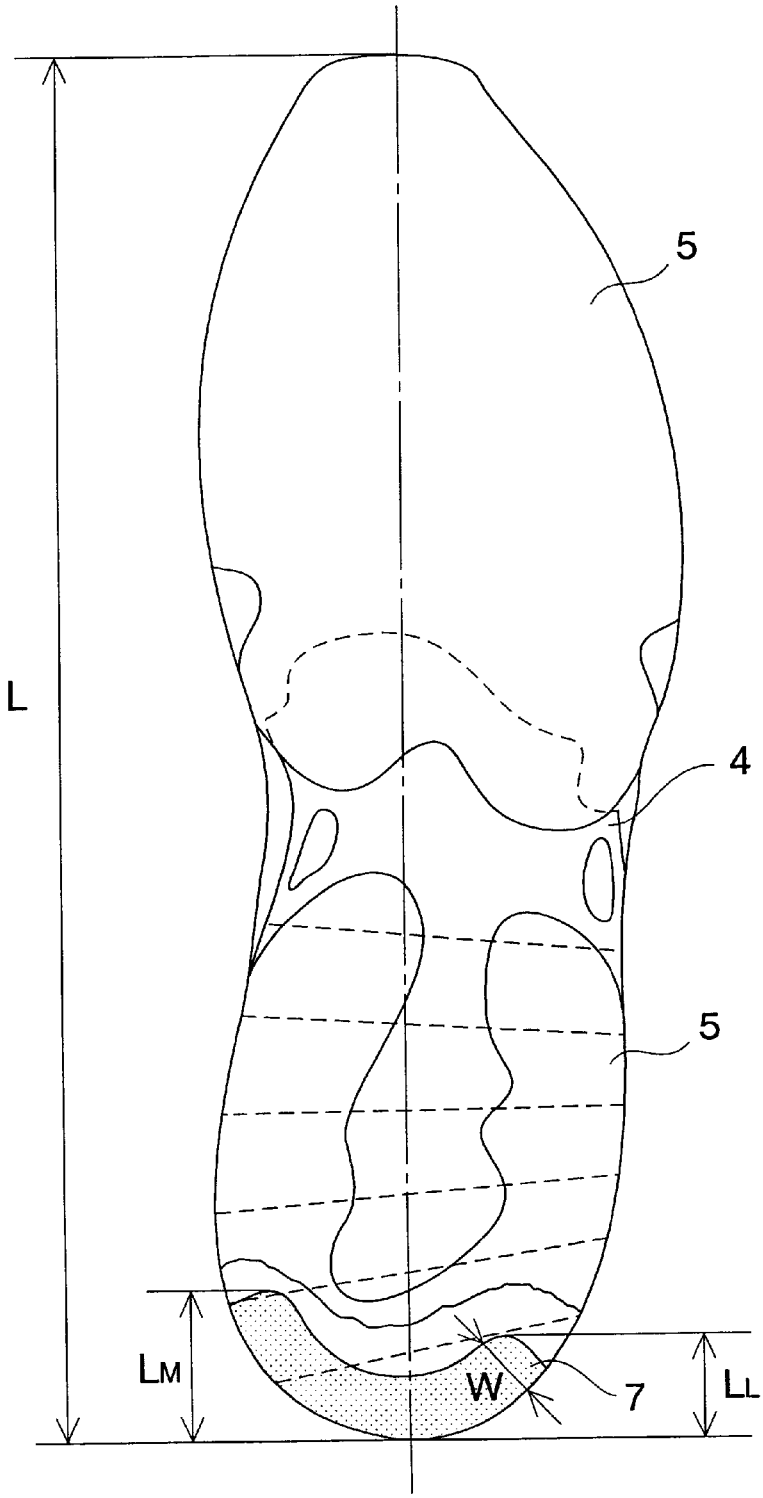
FIGS. 5A and 5B are cutaway bottom views like FIG. 5, but respectively show the alternative sole structures of FIGS. 4A and 48.
Figure 5B:
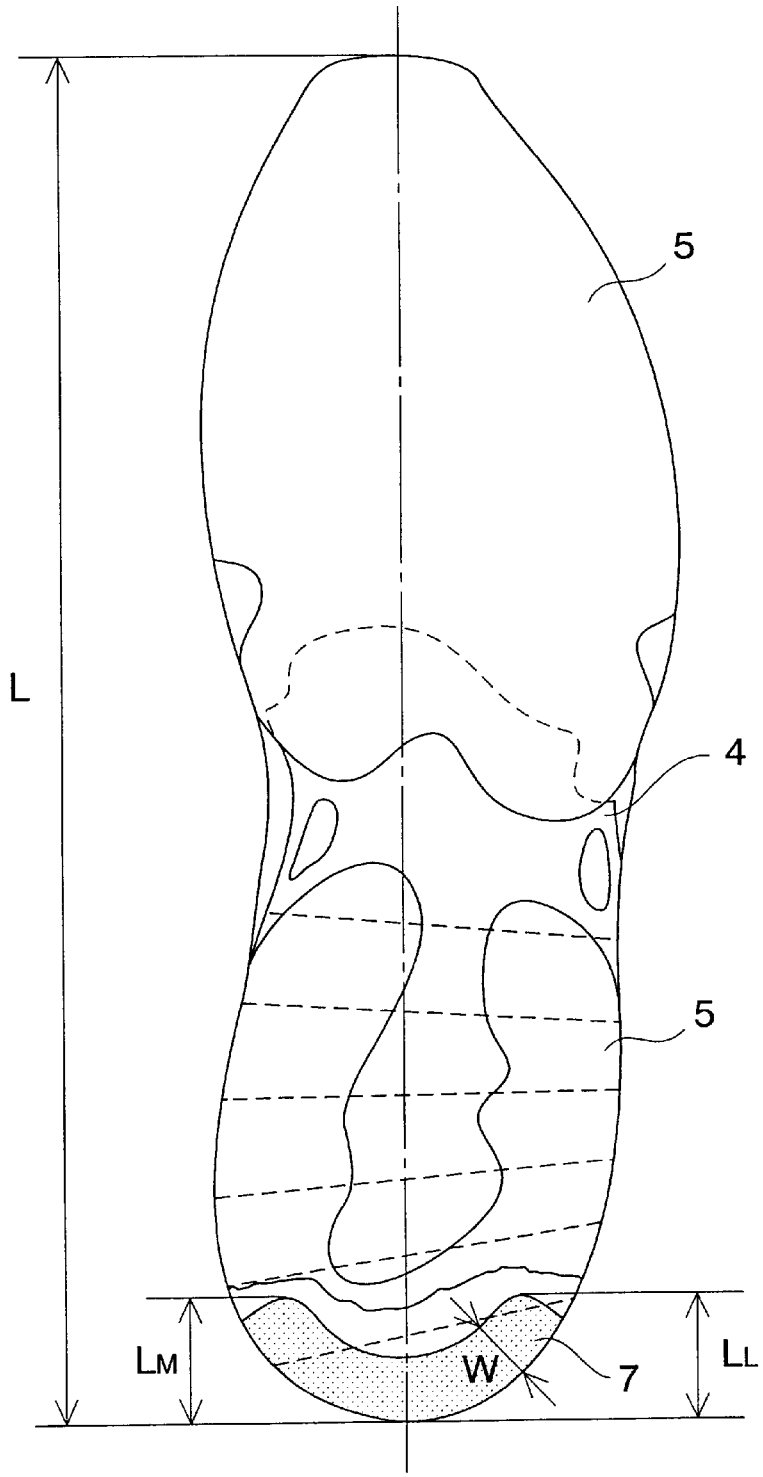
Figure 6A:
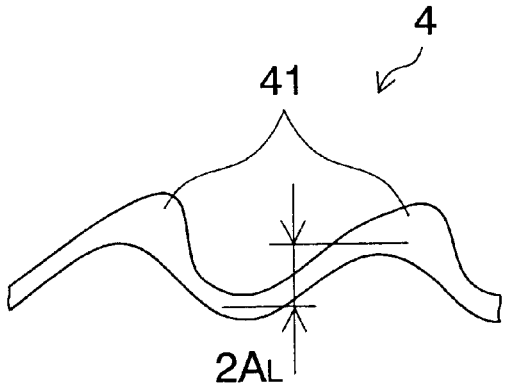
FIGS. 6A and 6B are lateral side views of a portion of the wavy plate similar to FIG. 6, but relating to two alternative embodiments.
Figure 7A:
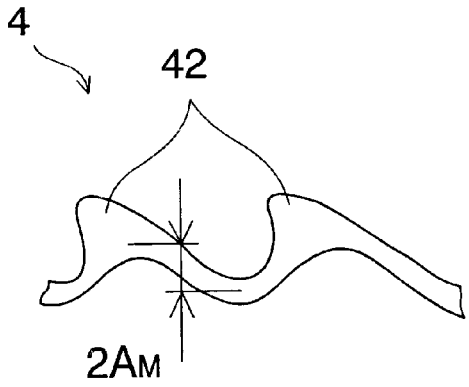
FIGS. 7A and 7B are medial side views of a portion of the wavy plate in the alternative embodiments of FIGS. 6A and 6B.
Figure 6B:
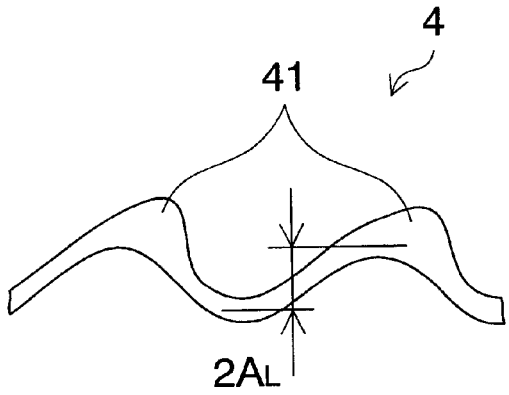
Figure 7B:
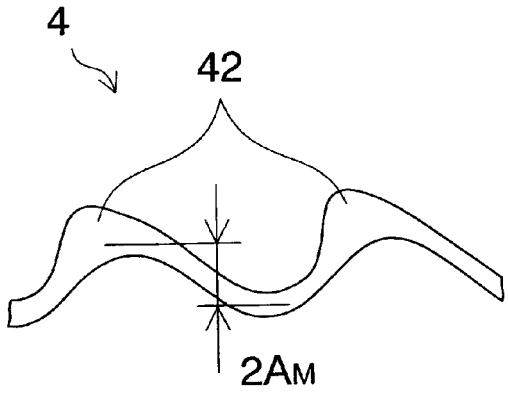

In the above-mentioned embodiment, a running shoe has been taken as an example, but the present invention can also be applied to a shoe other than a running shoe For example, in the case of a tennis shoe or a basketball shoe as shown in FIGS. 4A and 5A, medially and laterally extending portions $L_M$ and $L_L$ of the shock absorbing member 7 are reversed as compared to the running shoe. And as shown in FIGS. 6A and 7A, the amplitudes AM and $A_L$ of the medial and lateral sides of the wavy plate 4 are also reversed as compared to the running shoe. That is, $$0.1L \leqq L_M \leqq 0.5L,\ L_L \leqq 0.1L,\ A_M < A_L$$

In this case, the shock absorbing member 7 is provided along a longer region at a medial side than at a lateral side. Such a sole structure is suitable for a tennis shoe or a basketball shoe because tennis or basketball players move more often in the lateral direction and land on the ground more frequently from the medial side of the heel portion.

Here, the reason why the elongated length $L_M$ of the shock absorbing member is limited to 0.1L or more is that at least the length of 0.1L is required to absorb a shock directly after landing from the medial side. The reason why the elongated length $L_M$ is limited to 0.5L or less is as follows: It is sufficient that the shock absorbing member extends to the midfoot portion at the longest, and if the shock absorbing member has the length over 0.5L, it reaches the forefoot portion. Further, the reason why the elongated length $L_L$ is limited to 0.1L or less is that if the length is over 0.1L it promotes supination.

Furthermore, in this case, amplitude of a wavy configuration of the wavy plate 4 at the heel portion is smaller on the medial side and greater on the lateral side. That is, moment I of inertia of area of the wavy plate 4 is greater on the lateral side and smaller on the medial side, and thus, compressive hardness, which represents hardness to compressive deformation of the whole midsole, is higher on the lateral side.

Consequently, in this case, when a tennis or basketball player lands on the ground from the medial side of the heel part A during a game, the shock absorbing member 7 on the medial side absorbs a shock to the outsole directly after contacting the ground. The lateral side of the midsole having greater compressive hardness sustains leaning of a foot toward the lateral side of the heel portion after landing. Thus, lateral deformation of the heel part A after landing is prevented and supination of a shoe wearer's foot is prevented. In such a way, by interaction between the shock absorbing member 7 and the wavy plate 4, a shock applied to the shoe heel portion directly after contacting the ground is effectively absorbed and supination of a shoe wearer's foot is securely prevented.

Alternative Embodiment 2

The present invention can further be applied to a shoe such as a walking shoe, which strikes onto the ground more often from a generally central portion of a shoe heel part on a rear end side. In this case, as shown in FIGS. 4B, 5B, 6B, and 7B, $$0.1L \leqq L_L \leqq 0.15L,\ 0.1L \leqq L_M \leqq 0.15L,\ A_M \approx A_L$$

Here, $L_M$ and $L_L$ are medially and laterally extending portions of the shock absorbing member 7, respectively. $A_M$ and $A_L$ are amplitudes of the medial and lateral sides of the wavy plate 4, respectively.

In this case, both extending portions of the shock absorbing member 7 on the medial and lateral sides do not need to be different from each other, and they are set to be nearly the same length.

Here, the reason why each of the elongated lengths $L_L$ and $L_M$ of the shock absorbing member 7 is limited to 0.1L or more is that at least the length of 0.1L is required to absorb a shock directly after landing from the rear central portion of the heel portion. The reason why the elongated lengths $L_L$ and $L_M$ are 0.15L or less is as follows: It is sufficient that the shock absorbing member has a length of 0.15L at the longest to absorb a shock applied to the rear central portion of the heel portion.

In this case, since a shoe wearer lands on the ground from the rear central portion of the heel portion, pronation or supination hardly occurs. Thus, it is not necessary to alter amplitude of a wavy configuration between the medial side and the lateral side of the heel portion of the wavy plate, and amplitudes between the medial and the lateral sides are made nearly equal.

As explained above in greater detail, according to the sole structure of the athletic shoe of the present invention, a shock applied to the shoe heel part directly after landing is effectively absorbed and pronation or supination of a shoe wearer's foot can be securely prevented. The sole structure of the present invention is useful for athletic shoes, such as running shoes, tennis shoes, basketball shoes, walking shoes, or the like.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure of an athletic shoe comprising:

an upper midsole that is formed of a soft elastic material and that extends from a heel portion of said sole structure to a forefoot portion of said sole structure;

a lower midsole that is formed of a soft elastic material and that is disposed at least at a part of said heel portion under at least a part of said upper midsole;

a wavy plate that is provided between said upper midsole and said lower midsole and that has a wavy configuration at least at said heel portion and progressing to a midfoot portion of said sole structure;

an outsole fitted to a bottom surface of said lower midsole; and a shock absorbing member that is formed of a viscoelastic material having at least 70% energy loss, and that is arranged in said heel portion between said wavy plate and said outsole and extending from a rearmost end of said heel portion to a rear edge of said lower midsole in said heel portion.

2. The sole structure of claim 1, wherein said viscoelastic material has 85% or more energy loss.

3. The sole structure of claim 2, wherein said shock absorbing member has a hardness of $H_AC$ on an Asker C scale, said hardness of $H_AC$ satisfying an inequality, $H_AC \leqq 55$.

4. The sole structure of claim 3, wherein said shock absorbing member is shaped as a curved strip that extends along an outer perimeter of said heel portion at said rearmost end, and said curved strip has a width of 10 mm or more.

5. The sole structure of claim 2, wherein said shock absorbing member is shaped as a curved strip that extends along an outer perimeter of said heel portion at said rearmost end, and said curved strip has a width of 10 mm or more.

6. The sole structure of claim 5, wherein there exist inequalities, $$0.1L \leqq L_L \leqq 0.5L \text{ and } L_M \leqq 0.1L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

7. The sole structure of claim 6, wherein an amplitude of a wavy corrugation of said wavy plate at said heel portion is smaller on the lateral side and greater on the medial side.

8. The sole structure of claim 5, wherein there exist inequalities, $$L_L \leqq 0.1L \text{ and } 0.1L \leqq L_M \leqq 0.5L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

9. The sole structure of claim 8, wherein an amplitude of a wavy corrugation of said wavy plate at said heel portion is smaller on the medial side and greater on the lateral side.

10. The sole structure of claim 5, wherein there exist inequalities, $$0.1L \leqq L_L \leqq 0.15L \text{ and } 0.1L \leqq L_M \leqq 0.15L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

11. The sole structure of claim 10, wherein amplitude of a wavy configuration of said wavy plate at said heel portion is generally equal between a medial side and a lateral side.

12. The sole structure of claim 2, wherein there exist inequalities, $$0.1L \leqq L_L \leqq 0.5L \text{ and } L_M \leqq 0.1L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

13. The sole structure of claim 2, wherein there exist inequalities, $$L_L \leqq 0.1L \text{ and } 0.1L \leqq L_M \leqq 0.5L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

14. The sole structure of claim 13, wherein an amplitude of a wavy corrugation of said wavy plate at said heel portion is smaller on the medial side and greater on the lateral side.

15. The sole structure of claim 2, wherein there exist inequalities, $$0.1L \leqq L_L \leqq 0.15L \text{ and } 0.1L \leqq L_M \leqq 0.15L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

16. The sole structure of claim 15, wherein amplitude of a wavy configuration of said wavy plate at said heel portion is generally equal between a medial side and a lateral side.

17. The sole structure of claim 1, wherein said shock absorbing member has a hardness of $H_AC$ on an Asker C scale, said hardness of $H_AC$ satisfying an inequality, $H_AC \leqq 55$.

18. The sole structure of claim 17, wherein said shock absorbing member is shaped as a curved strip that extends along an outer perimeter of said heel portion at said rearmost end, and said curved strip has a width of 10 mm or more.

19. The sole structure of claim 1, wherein said shock absorbing member is shaped as a curved strip that extends along an outer perimeter of said heel portion at said rearmost end, and said curved strip has a width of 10 mm or more.

20. The sole structure of claim 19, wherein there exist inequalities, $$0.1L \leqq L_L \leqq 0.5L \text{ and } L_M \leqq 0.1L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

21. The sole structure of claim 20, wherein an amplitude of a wavy corrugation of said wavy plate at said heel portion is smaller on the lateral side and greater on the medial side.

22. The sole structure of claim 20, wherein an amplitude of a wavy corrugation of said wavy plate at said heel portion is smaller on the lateral side and greater on the medial side.

23. The sole structure of claim 12, wherein an amplitude of a wavy corrugation of said wavy plate at said heel portion is smaller on the lateral side and greater on the medial side.

24. The sole structure of claim 19, wherein there exist inequalities, $$L_L \leqq 0.1L \text{ and } 0.1L \leqq L_M \leqq 0.5L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

25. The sole structure of claim 24, wherein an amplitude of a wavy corrugation of said wavy plate at said heel portion is smaller on the medial side and greater on the lateral side.

26. The sole structure of claim 19, wherein there exist inequalities, $$0.1L \leqq L_L \leqq 0.15L \text{ and } 0.1L \leqq L_M \leqq 0.15L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

27. The sole structure of claim 26, wherein amplitude of a wavy configuration of said wavy plate at said heel portion is generally equal between a medial side and a lateral side.

28. The sole structure of claim 1, wherein there exist inequalities, $$0.1L \leqq L_L \leqq 0.5L \text{ and } L_M \leqq 0.1L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

29. The sole structure of claim 1, wherein there exist inequalities, $$L_L \leqq 0.1L \text{ and } 0.1L \leqq L_M \leqq 0.5L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

30. The sole structure of claim 29, wherein an amplitude of a wavy corrugation of said wavy plate at said heel portion is smaller on the medial side and greater on the lateral side.

31. The sole structure of claim 1, wherein there exist inequalities, $$0.1L \leqq L_L \leqq 0.15L \text{ and } 0.1L \leqq L_M \leqq 0.15L;$$

where L is an entire length of a horizontal projection plane of said outsole, $L_L$ is a length of a laterally extending portion of said shock absorbing member, said length $L_L$ being measured from said rearmost end of said heel portion along a shoe elongated direction, and $L_M$ is a length of a medially extending portion of said shock absorbing member, said length $L_M$ being measured from said rearmost end of said heel portion along said shoe elongated direction.

32. The sole structure of claim 31, wherein amplitude of a wavy configuration of said wavy plate at said heel portion is generally equal between a medial side and a lateral side.

33. The sole structure of claim 1, wherein an amplitude of a wavy corrugation of said wavy plate at said heel portion is smaller on the lateral side and greater on the medial side.

* * * * *

UNITED STATES PATENT AND TRADEMARK OFFICE

CERTIFICATE OF CORRECTION

PATENT NO. : 6,711,834 B1
DATED : March 30, 2004
INVENTOR(S) : Kita

It is certified that error appears in the above-identified patent and that said Letters Patent is hereby corrected as shown below:

Title page,
Item [57], ABSTRACT,
Lines 1 to 17, cancel and replace to read:
-- A sole structure of an athletic shoe aims to absorb a shock applied to a shoe heel portion and to prevent pronation or supination after landing. The sole structure includes an upper midsole (3a) that is formed of a soft elastic material and that extends from the heel portion to a forefoot portion through a midfoot portion, a lower midsole (3b) that is formed of a soft elastic material and that is disposed at least at the heel portion under the upper midsole (3a), a wavy plate (4) that is inserted between the upper and lower midsoles (3a, 3b) and that has a wavy corrugation at least at the heel portion to the midfoot portion, an outsole (5) fitted to the bottom surface of the lower midsole (3b), and a shock absorbing member (7) of a lossy viscoelastic material provided at a heel strike region of the heel portion between the wavy plate (4) and the outsole (5). --

Column 2,
Line 48, after "not", delete "liveried".

Column 6,
Line 7, after "3b,", replace "and" by -- an --;
Line 35, after "polystyrene," replace "polyplefin," by -- polyolefin, --.

Column 8,
Line 67, after "amplitudes", replace "AM" by -- $A_M$ --.

Signed and Sealed this

Twenty-fourth Day of August, 2004

JON W. DUDAS
*Director of the United States Patent and Trademark Office*